US005695670A

United States Patent [19]

Fujii et al.

[11] Patent Number: 5,695,670

[45] Date of Patent: Dec. 9, 1997

[54] DIAMOND HEATER

[75] Inventors: Satoshi Fujii; Takashi Tsuno, both of Hyogo, Japan

[73] Assignee: Sumitomo Electric Industries, Ltd., Osaka, Japan

[21] Appl. No.: 354,837

[22] Filed: Dec. 8, 1994

[30] Foreign Application Priority Data

Dec. 9, 1993 [JP] Japan ..... 5-341568

[51] Int. Cl.[6] ..... H05B 3/16; H01C 3/04

[52] U.S. Cl. ..... 219/543; 338/22.5 D

[58] Field of Search ..... 219/543, 541, 219/544, 553; 338/22 SD; 257/77

[56] References Cited

U.S. PATENT DOCUMENTS

| | | | |
|---|---|---|---|
| 3,813,520 | 5/1974 | Brouneus | 219/543 |
| 4,203,198 | 5/1980 | Hackett et al. | 219/543 |
| 5,089,802 | 2/1992 | Yamazaki | 338/22 SD |
| 5,144,380 | 9/1992 | Kimoto et al. | 357/22 |
| 5,173,761 | 12/1992 | Dietrich et al. | 257/77 |
| 5,183,530 | 2/1993 | Yamazaki | 156/643 |
| 5,252,840 | 10/1993 | Shiomi et al. | 257/77 |
| 5,264,681 | 11/1993 | Nozaki et al. | 219/544 |
| 5,432,357 | 7/1995 | Kato et al. | 257/77 |
| 5,435,889 | 7/1995 | Dietrich | 216/63 |
| 5,436,505 | 7/1995 | Hayashi et al. | 257/77 |
| 5,488,350 | 1/1996 | Aslam et al. | 338/225 |
| 5,493,131 | 2/1996 | Miyata et al. | 257/77 |

FOREIGN PATENT DOCUMENTS

| | | |
|---|---|---|
| 0 379 359 | 7/1990 | European Pat. Off. . |
| 0 518 532 | 12/1992 | European Pat. Off. . |
| 61-236113 | 10/1986 | Japan . |
| 3-25880 | 2/1991 | Japan . |
| 680203 | 8/1979 | U.S.S.R. . |
| 1142240 | 2/1985 | U.S.S.R. . |

*Primary Examiner*—Teresa J. Walberg
*Assistant Examiner*—Sam Paik
*Attorney, Agent, or Firm*—Cushman Darby & Cushman Intellectual Property Group of Pillsbury Madison & Sutro LLP

[57] ABSTRACT

Continual boron-doped diamond parts with ends are formed in a non-doped insulating diamond crystal. Ohmic electrodes are deposited on the ends of the boron-doped diamond parts. Non-doped diamond encloses and insulates the boron-doped diamond parts. When the boron-doped diamond parts are supplied with a current, the boron-doped diamond parts generate Joule's heat. The device acts as a heater. Since the whole heater is made of diamond crystal, the heater can posses an extremely small size. The heater enjoys high resistance against high temperature, especially in an anaerobic atmosphere. The diamond heater can be adopted in vacuum or in liquid, since the insulating diamond layers are highly resistant against vacuum and liquid.

13 Claims, 4 Drawing Sheets

DIAMOND HEATER

FIELD OF THE INVENTION

This invention relates to a heater, especially to a small-sized heater used in vacuum or a heater used in liquid which requires the provision of insulation between the heater and the surrounding liquid.

BACKGROUND OF THE INVENTION

This application claims the priority of Japanese Patent Application No.341568/1993 filed Dec. 9, 1993, which is incorporated herein by reference.

A heater is a device which generates heat by letting a current flow therethrough. The resistance of the heater produces Joule's heat from the current. Conventional heaters have adopted metal wires as a conduction material for generating heat, for example, a nichrome (Ni—Cr) wire, a kanthal (Fe—Cr—Al) wire, etc. Such metal wires are chemically stable and highly resistant to oxidization even in high temperature surroundings. Furthermore, the metal wires have enough electric resistance to apply a voltage for yielding heat. The high-resistance metal wire heaters have been used for various purposes. The metal heaters are inexpensive in general. Metal heaters can utilize a bare wire, when the heaters are only in contact with an insulator and air.

Metal wires must be enclosed, however, by mica plates or a quartz tube for insulating the metal from the surroundings. Since a mica plate is planar, the heater wire must be sandwiched between two sheets of mica for insulation. In the case of insulating with quartz, the wire must be inserted into a quartz ($SiO_2$) tube. The quartz tube protects and insulates the metal wire heater from the environment. The enclosures of quartz or mica enlarge the volume or the area of the heater at least by the thickness of the enclosures. The enclosure makes the heater bulky by increasing its volume. The necessity of the additional enclosure makes it difficult to produce a small-sized heater.

The metal heater cannot be heated at a temperature higher than the melting point of the material metal. The melting points of the heater metals are about 2000° C. at most. In general, the melting points of metals are far lower than the melting points of oxides.

Nevertheless the melting point does not determine the upper limit of the temperature available for a heater. Enclosures are another usually the determinative factor for ascertaining the upper limit of the heater temperature. Enclosing the resistance wire by mica, quartz or other insulating medium reduces the heat conductivity. Poor conductivity raises the temperature difference between a central wire radiator and an outer surface of the enclosure. The highest temperature of the radiator wire must be lower than the melting point of the insulator. The surface temperature of the insulator of the metal heater is generally less than 1000° C.

Some cases, however, require to heat only a limited part of an object locally. Such cases necessitate a small-sized but high power heater. Conventional metal wire heaters are inappropriate because of the low density of radiation beams which is caused by the wide volume of the enclosure and the low temperature of the radiating wire.

OBJECTS AND SUMMARY OF THE INVENTION

It is an object of the present invention to provide a small-sized heater.

Another object of the present invention is to provide a high power heater for localized heating.

Another object of the present invention is to provide a heater suitable for application in a vacuum.

Another object of the present invention is to provide a heater suitable for application in liquid.

Another object of the present invention is to provide a heater which is capable of being heated at an extreme high temperature.

A still further object of the present invention is to provide a heater exhibiting enjoying a long lifetime.

A heater of this invention includes a diamond insulator, at least one boron-doped diamond conductive line having ends produced by doping boron into diamond, and electrodes formed on the ends of the at least one conductive line. When voltage is applied between the electrodes, currents flow in the at least one conductive line, thereby generating Joule's heat. The heater is named a diamond heater hereafter, because main parts of the heater are constructed by diamond. A diamond heater of this invention is produced by making a boron-doped part along a line in an insulator diamond crystal. The insulator diamond is non-doped diamond which acts as an insulating enclosure. The number of the electrodes is not restricted to two. Three or more than three electrodes are also available for the diamond heater. The electrodes are deposited on the ends of the conductive diamond line. The conductive diamond line can take an arbitrary shape, for example, a meandering line, a coiling line, a curling line, etc.

A longer conductive line imparts a higher resistance to the line. A long line is equivalent to a series connection of short conductive lines. A meandering conductive line distributed uniformly enables the heater to average out the heat generation in the surface of the heating device. The flattening of the heat generating density is also achieved by a coiling line distributed uniformly.

The number of the conductive lines connecting two electrodes is not restricted to one. Two or more than two lines are also applicable for the conductive lines on a diamond heater. When two electrodes are connected by a plurality of conductive lines, the radiating power is increased by lowering the effective resistance of the connecting lines. The connection by a plurality of conductive lines is equivalent to the parallel connection of resistors. The adoption of more than two conducive lines enables the heater to change the radiation density locally on the surface.

Functions of the device are now clarified. Natural diamond is an insulator. Synthetic diamond is also an insulator, if it is not doped with a dopant (impurity). Nobody has utilized diamond as a heating device, because diamond has been long deemed as an insulator. No insulator can be a heater material which generates Joule's heat by applying voltage. Thus nobody has suggested a slight probability of diamond as a heating device.

Diamond is an excellent material endowed with many conspicuous properties. Diamond has been utilized as jewels, accessories or ornaments because of its high price and unequalled beauty. The extreme hardness makes diamond suitable for applications such as for a material of cutlery of cutting tools. The powder of diamond is also utilized as a whetstone by bonding the powder on a substrate by a resin, etc., for its excellent rigidity. Ornaments, cutlery, cutting tools and diamond whetstones are the main uses of diamond.

In addition to the above-discussed features, that is, high price, unequalled hardness and brilliant beauty, diamond has still other advantages. Diamond enjoys high heat conductivity. A diamond heat sink is one of the devices which take advantage of the excellent heat conduction of diamond. The diamond heat sink is used for removing the heat radiated from semiconductor devices. Such a diamond heat sink is far superior to an aluminum heat sink due to the high heat conductivity. However, diamond heat sinks are employed for cooling only restricted sorts of semiconductor devices because of its high cost.

Diamond is light in weight and rigid against deformation. Thus diamond has the biggest bending rigidity among all materials. Diamond has another use as a speaker vibration plate, in particular, for a high frequency sound. Although diamond has many uses as mentioned above, all the devices make use of insulator diamond. Since diamond is a highly expensive material, diamond has not been fully exploited despite its various advantages. High cost still restricts the applications of diamond into a narrow scope. Intrinsically being an insulator, diamond has never been deemed as a resistor material of a heating device. A diamond heater has never been proposed until now.

There are generally two methods for synthesizing diamond. One is an ultrahigh pressure synthesis method which applies ultrahigh pressure and high temperature upon a carbon material, and syntheses a diamond bulk crystal by the action of the enormous heat and the high pressure. The other method employs a thermal CVD method or a plasma CVD method. A diamond thin film is formed on a base substrate thereby.

The ultrahigh pressure method enables the production of a bulk diamond crystal. The CVD method is suitable for producing a thin film diamond. Nevertheless, the CVD method can make also a thick diamond polycrystal or a thick diamond single crystal by prolonging the reaction.

Natural diamond is an insulator. The diamond synthesized by the ultrahigh pressure method is also an insulator. Therefore, it is a matter of course that diamond has never been adopted as a heater resistor. The CVD method excels in the freedom of choice of the material gas, since the CVD method supplies material gas flow onto a substrate, induces a chemical reaction, and deposits the created material on the substrate.

Further diamond has other surpassing features, that is, a wide band gap, strong heat resistance in a non-oxidizing atmosphere and a high melting point, which is as high as 4000° C. in a non-oxidizing atmosphere. Since diamond has high heat conductivity in addition to its superb properties, applications of diamond have been sought in devices which are subjected to high temperature, high densities of cosmic rays and radioactive rays or other rigorous conditions.

The fabrication of a semiconductor device requires the formation of a p-type region, an n-type region and a pn-junction in the medium. Non-doped diamond is an insulator, whereas diamond doped with an impurity, for example B (boron), has little conductivity.

The CVD synthesis enables impurities to be doped into diamond. An investigation of semiconductor diamond reveals that the doping of boron brings about the conversion from insulating diamond to p-type semiconductor diamond. However, no other dopant as a p-type impurity is known at present. It is further difficult to convert the property into n-type semiconductor by doping some dopant. The doping of an n-type impurity is far more difficult. Nobody has succeeded in obtaining n-type conduction of diamond with low resistance. The difficulty of making an n-type region forbids the fabrication of a good pn-junction of diamond. Thus a Schottky Junction will perhaps be adopted as a rectifying junction instead of a pn-junction.

On the contrary, pure diamond is an insulator. The resistivity is very high. The crystalline structure is referred to as a diamond structure, i.e. s-$p^3$ hybridization of the covalent bonds of cubic symmetry. Silicon also possesses the diamond structure. The crystal structure is common to diamond and silicon. But a carbon atom has a smaller atomic radius and a stronger bonding energy than a silicon atom in a covalent bond. The smaller atomic radius and the stronger bond impede the invasion of impurity atoms in to a diamond crystal. The doping of impurities is difficult for a diamond substrate. If some impurity atoms have been doped somehow into a diamond crystal, contrary to expectations the electric resistance could not be reduced by the impurity doping. The doped impurity atom would not supply an electron or a hole to the host diamond structure. The diamond remains an insulator in spite of the impurity doping. Furthermore, the impurity doping into diamond lacks reproductivity.

Conditions suitable for doping of impurities other than boron into diamond is unclear. Only boron can be doped into diamond with a sufficient dose and a sufficient productivity at present. The CVD method enables boron atoms to penetrate into the diamond structure by mixing a gaseous boride with a material gas.

The present invention takes advantage of the property of diamond that doping of boron makes a p-type diamond. The part doped with boron becomes a semiconductor diamond with a lower resistivity than the other undoped part. Even if diamond is doped with boron, the diamond cannot come to be a good conductor of electric current. Boron-doped diamond has still a considerable amount of resistivity. A material of a resistor heater rather demands sufficient resistance. If not, a satisfactory voltage cannot be applied to the material. The Inventors think that a semiconductor is suitable for a resistor heater material rather than a conductive material.

Therefore, the Inventors have had an idea of making a heater by producing continual conductive lines by doping boron into a diamond substrate, depositing electrodes on the ends of the conductive lines, and supplying a current to the conductive lines as a heat-radiating medium. The present invention is the fruit of this idea.

The boron doped conductive lines and the other non-doped parts can be selectively formed on an insulating diamond crystal by the current photolithography. The boron-doped parts act as conductive and heat-radiating lines. The concentration of the doped boron should be higher than $10^{19}$ $cm^{-3}$. Preferably the boron concentration is higher than $10^{20}$ $cm^{-3}$. The non-doped parts act as an insulating enclosure. If such a diamond device is used as a heater, the conductive lines generate heat by the current supply, and the non-doped parts act as an insulator of the conductive lines. The device will enjoy the merit that both the conductive lines and the insulating enclosures can be made from the same material. The heater may be called a uni-material heater.

This advantage has never been found in other heating materials. Metals cannot make such a heater in which a common material is used for heat generating parts and the insulating parts, because metals are not capable of forming insulating parts by themselves. Silicon cannot build such a uni-material heater, because even intrinsic silicon leads an enough current and an insulating enclosure cannot be built by silicon.

There has never been a heater containing conductive parts and insulating parts which are made from the same material. A diamond heater is the first heater which satisfies the contradictory condition that the same material should play both the role of conduction and the role of insulator.

The uni-material heater has two advantages. A conductive wire is not enveloped in an independent insulating tape or an independent insulating sheet which would occupy an extra large space or an extra large area. Since the present heater can dispense with such independent insulating parts, the heater requires no more extra space or area for the insulation. Common materials enable to size the heater smaller than the conventional ones which are constructed with two different materials. A small sized heater can be easily fabricated on a diamond crystal by applying the present technology of lithography of semiconductor devices.

The other advantage relates to the problem of thermal expansion. In the case of a conventional metal heater, a metal wire and an insulator (e.g. mica, quartz, etc.) have different thermal expansion coefficients. A rise or a fall of temperature induces a difference in the expansion or the shrinkage between the central wire and the surrounding insulator. The repetition of the relative expansion or shrinkage invites cracks in the insulator or breaks in the wire. The diamond heater of the present invention is, however, fully immune from the problem of the difference in the thermal expansion, because the conductive parts and the insulating parts have the same thermal expansion coefficient. There is no probability of the occurrence of cracks in the insulating parts or breaks in the conductive lines in the present invention.

The advantages of this invention will now be explained again. This invention employs a diamond crystal as conductive lines and insulating enclosures of a heating device. The conductive lines are built by boron-doped diamond. The insulator enclosures are made of non-doped diamond.

Electrical conduction can be obtained even in diamond by doping boron atoms. Even if boron is doped to considerably high density, the doped diamond has a sufficient high resistivity which is pertinent to a resistor heater. The high resistance enables the boron-doped lines to act as a resistance of a heater.

Since the heat-radiation parts and the insulating parts are produced by the same material, the heater has a very simple structure. High heat conductivity of diamond allows the heater to have a high heat radiation density.

The heater of the invention is quite stable to chemical reactions. Thus the heater can be adopted in the surroundings which is likely to be contaminated with acid, alkali or other corrosive chemicals. Since the diamond insulator forbids liquid to penetrate into the heater line, the heater can be used in liquid, e.g., for heating liquid medicines or liquid pharmaceutics. If the heater is shaped in a bar, an object liquid can be simply heated by dipping the bar heater into a vessel containing the liquid.

The heater can domestically be employed for boiling water. Since the diamond protecting enclosure exhausts neither gas nor vapor, the heater can be used in vacuum. It is feasible to use the heater for heating a sample to be analyzed in an analyzing apparatus which employs electron beams in vacuum.

DETAILED DESCRIPTION OF THE PREFERRED EMBODIMENTS

Figure 1:
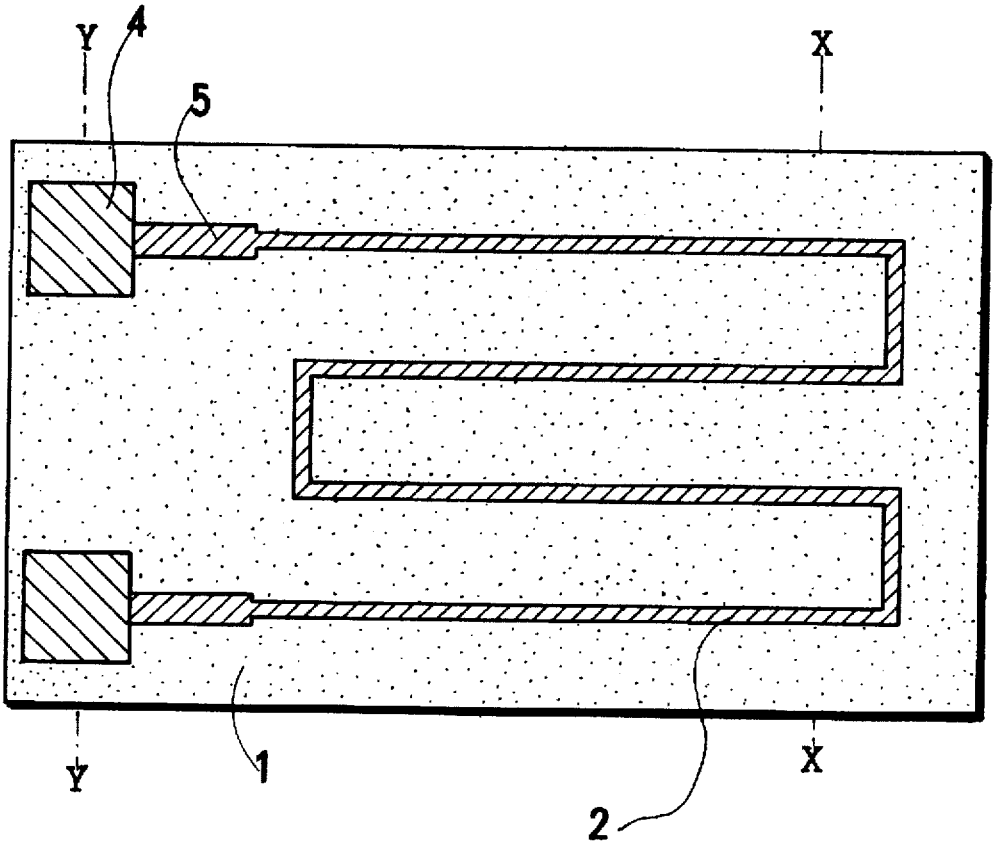
FIG. 1 is a horizontally-sectioned view of a heater made of diamond of the present invention.
Figure 2:
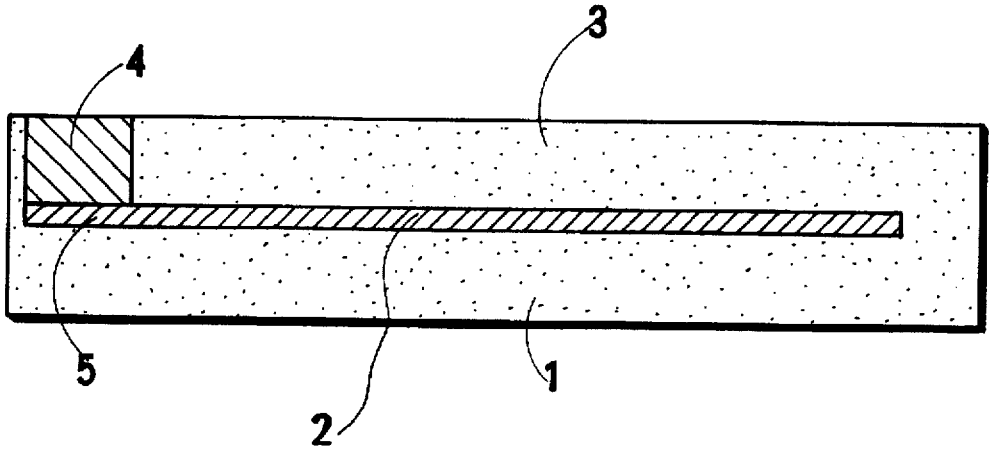
FIG. 2 is a vertically-sectioned view of the same heater of this invention.

FIG. 1 is a horizontally-sectioned view of a heater of this invention. FIG. 2 shows a vertically-sectioned view of the same heater. A substrate (1) is made from a non-doped diamond single crystal or poly-crystal. The substrate diamond may be made from a synthetic diamond crystal made by the ultrahigh pressure method or the CVD method, or the substrate diamond may be made from a natural diamond crystal.

The CVD method forms a non-doped diamond film on the diamond substrate. Boron atoms are doped into a continual linear region on the CVD-grown diamond thin film selectively by photolithography. The linear region becomes a conductive line (2) with low resistivity by the boron-doping. This example exhibits a three-times meandering (twice round-trips) path for enhancing the total resistance by prolonging the effective path. The number of the round-trips is not limited to two. More than two round-trips of the line are also useful for enhancing the resistance and flattening the distribution of heat yields. A spiral pattern with a central end and an outer end is also applicable to the conductive line of this invention. Any continuous line pattern is suitable for the conductive line. In any case, the conductive line (2) is fully enclosed by the non-doped diamond layers (1) and (3).

The ends of the conductive line (2) are wide doped parts (5) which have broader widths of doping than the line (2). Ohmic electrodes (4) are formed on the wide doped ends (5). Titanium (Ti) is evaporated or sputtered on the ends (5) of the conductive line (2), since Ti can make a good ohmic contact with boron-doped diamond. The ends (5) have wide areas for reducing the contact resistance between the Ti layer and the boron-doped p-type diamond. Instead of enlarging the areas of the ends (5), it is also available to enhance the doping concentration of boron at the ends (5) for lowering the contact resistance of the electrodes (4). It is preferable to cover the top of the electrode metal, i.e., Ti, with a gold (Au) layer. Thus the electrode (4) has a two layer structure of Ti and Au.

Another non-doped diamond layer (3) is further grown on the boron doped conductive line (2) and the enclosing non-doped diamond layer (1) to protect and insulate the conductive line (2). Thus the boron-doped p-type diamond part (2) is enclosed three-dimensionally by the non-doped diamond. If the electrodes (4) are connected to a power source (not shown in the figures), an electric current flows in the boron-doped semiconductor diamond (2). The doped line (2) plays the role of a radiating line for generating heat. The non-doped insulator diamond part acts as an enclosure.

Because the diamond heater has outer portions consisting of non-doped insulating diamond, the central heating part is fully shielded electrically by the outer insulating diamond from external matters. Since the insulating parts and the conductive parts are made from the same material by the same method, the heater of the present invention is sized far smaller than the conventional heaters. This invention enables the production of an ultra-small heater. The unification of the heater wire and the insulation envelope gives wide freedom for selecting the shape of a heater. For example, it is easy to make a rectangular heater, a circular heater, a cubic heater, a columnar heater, a thin film heater, a linear heater or a planar heater.

The insulating, protecting part is made from diamond which is excellent in heat conductivity. The heat yielded in the conductive part (2) is quickly transferred through the insulator diamond enclosures (3) and (1). The high heat conductivity of the diamond protection layers (3) and (1) minimizes the difference of temperature between the heating part and the enclosures. The heat conduction can be further raised by thinning the thickness of the enclosing layers (1) and (3). The surface of the envelope is heated to a higher temperature than the conventional metal heater.

Since the same material composes both the heating part and the protection part, no exfoliation occurs between the non-doped diamond layers and the boron-doped diamond layer. Furthermore, many repetitions of heating and cooling induce no peeling at the interface between the heating diamond layer and the insulating diamond layers due to the same thermal expansion coefficient.

Since diamond is highly-resistant to acids, alkalis or other chemicals, this heater can be used in an acid atmosphere, an alkali atmosphere or other severe atmospheres.

The heater can be employed to achieve a considerable high temperature in a non-oxidizing atmosphere, since diamond has quite a high melting point of about 4000° C. in an anaerobic atmosphere.

The heater is suitable not only for use in vapor, but also in liquid, since the heat-radiating line is fully sealed by the compact diamond insulator layers which completely prevent water or other liquid from penetrating.

In addition to its utility in vapor and in liquid, this heater can be employed also in vacuum. This diamond heater is fully immune from air gaps or porous portions, which can adsorb water drops or gas molecules. There is no probability that the heater will pollute a vacuum or lower the degree of vacuum, because the surface of the diamond heater has adsorbed neither water nor gas. Unlike a metal heater or a carbon heater, no powder of the deteriorated heating parts swirls and pollutes the vacuum.

When the diamond heater is used in an aerobic atmosphere, the whole surface of the diamond heater should be coated with a carbide, for example, titanium carbide (TiC) or silicon carbide (SiC). Diamond is easily oxidized in an oxidizing atmosphere at high temperature. Carbides are, however, highly resistant to oxidization. Thus the carbide coating protects the diamond heater from being oxidized in an aerobic atmosphere.

FIG. 3 to FIG. 12 of the accompanying figures demonstrate the method, including the process steps, of producing a diamond heater of this invention. This embodiment adopts a Si wafer as a substrate and a CVD method for growing diamond layers.

Figure 3:
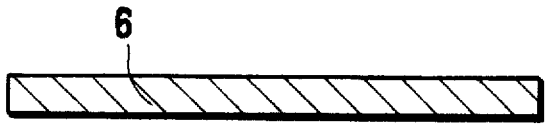
FIG. 3 is a sectional view of a starting substrate of Si at process step +e,cir +b 1+ee for fabricating the diamond heater of this invention.

As shown in FIG. 3, process step +e,cir +b 1+ee of this method involves placing A (100) Si single crystal wafer (6) on a susceptor of an ECR plasma CVD apparatus having a vacuum chamber, a magnetron, a coil, a heater and the susceptor. The ECR plasma CVD method deposits a film of an object composite on a substrate by supplying a material gas in the vacuum chamber, applying a longitudinal magnetic field, introducing a microwave in the chamber, and exciting the material gas by the microwave. The frequency of the microwave is equal to the cyclotron frequency of an electron in the longitudinal magnetic field. Electrons absorb microwave power in a resonant condition. For example, the cyclotron motion of electrons resonates with a frequency of 2.45 GHz of microwave under a longitudinal magnetic field of 875 gauss. Hydrogen gas and a hydrocarbon gas are introduced into the vacuum chamber for synthesizing non-doped diamond. In the case of formation of boron-doped diamond, another gas including boron besides hydrogen gas and hydrocarbon gas, and which includes boron, should be replenished into the reaction chamber. The boron-including gas is, for example, borane gas ($BH_3$) or diborane gas ($B_2H_6$) which is vapor at room temperature.

Figure 4:
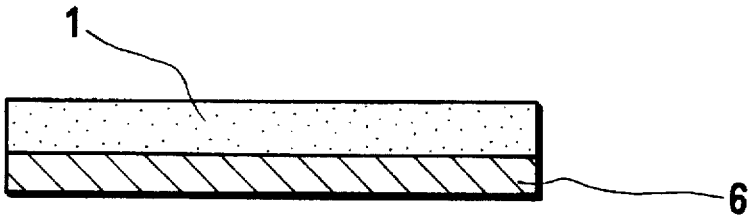
FIG. 4 is a sectional view of the Si substrate and a non-doped diamond layer at process step +e,cir +b 2+ee .

As shown in FIG. 4, in process step +e,cir +b 2+ee 100 sccm flux of hydrogen gas including 3% of methane ($CH_4$) is supplied from gas cylinders through a gas inlet into the ECR chamber in which the total pressure has been kept at 15 Torr (2000 Pa). Here "sccm" means standard cubic centimeters per minute. "Standard" means that the volume is designated by the value which is reduced to a volume at 0° C. under 760 Torr (0.1 MPa). The gases are replenished with a microwave of 300 W. The material gases are converted into plasma by the electrons excited by the microwave. The excited hydrocarbon and hydrogen react with each other in the plasma upon the Si substrate (6), synthesize diamond, and deposit a film of diamond on the Si substrate (6) heated at 500° C. 20 hour synthesis of diamond produces a non-doped polycrystalline diamond (1) of 100 μm in thickness.

Figure 5:
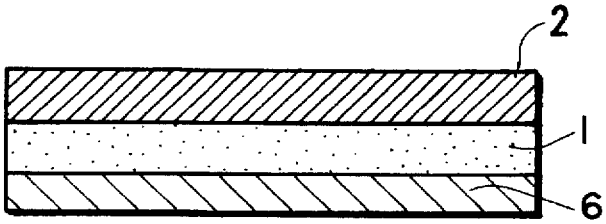
FIG. 5 is a sectional view of the Si substrate, the non-doped diamond and a boron-doped diamond layer at process step +e,cir +b 3+ee .

Referring to FIG. 5, in process step +e,cir +b 3+ee the ECR plasma CVD apparatus is supplied with hydrogen gas including 3% of methane ($CH_4$) and 1000 ppm of diborane ($B_2H_6$) as a material gas. The pressure is adjusted to be 15 Torr(2000 Pa). 300 W of microwave is introduced into the chamber. Boron-doped diamond (2) is deposited on the pure diamond (1) grown in process step +e,cir +b 2+ee . The reaction lasts for about ten hours. The boron-doped p-type diamond (2) has a boron concentration of $10^{21}$ $cm^{-3}$.

Figure 6:
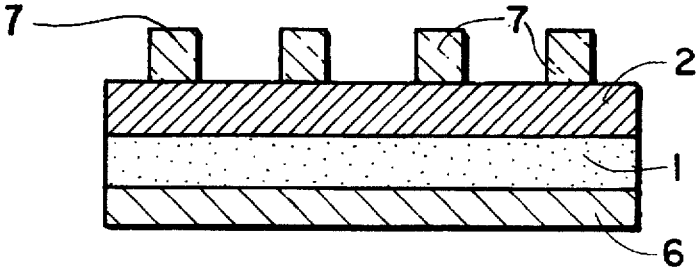
FIG. 6 is an X—X sectioned view in FIG. 1 of the Si substrate, the non-doped diamond, the boron-doped diamond layer and a resist layer patterned with a mask by photolithograpy at process step +e,cir +b 4+ee .
Figure 13:
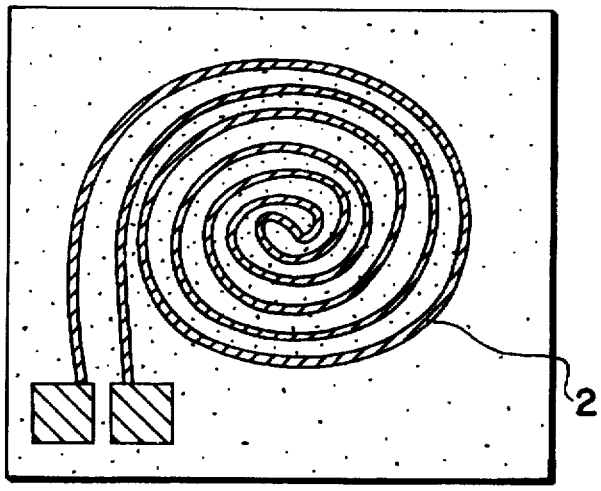
FIG. 13 is a plan view of a heater made of diamond in accordance with another embodiment of the present invention.

In process step +e,cir +b 4+ee , shown in FIG. 6, the sample is cooled and taken off from the chamber. A meandering, comb-like pattern of a resist (7) is further produced at the positions to be non-conductive parts on the boron-doped diamond layer (2) by the photolithography. Namely process step +e,cir +b 4+ee paints the resist (7) on the p-type diamond layer (2), bakes the wafer at a pertinent temperature, lays a mask having a pertinent pattern of the non-conductive parts on the baked the resist (7), and exposes the resist through the mask to ultraviolet rays by a mercury lamp for hardening the parts of the resist (7) after the pattern of the mask. The comb-like pattern of the conductive line can also be replaced by a spiral pattern (FIG. 13) or other suitable patterns. Arbitrary continuous patterns are suitable for the pattern of the conductive line which is made of the p-type semiconductor diamond (2).

Figure 7:
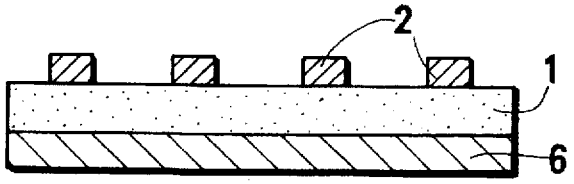
FIG. 7 is an X—X sectioned view in FIG. 1 of the Si substrate, the non-doped diamond, the selectively left boron-doped diamond layer at process step +e,cir +b 5+ee and 6 wherein the boron doped-layer is selectively etched away by the RIE.

In process step +e,cir +b 5+ee , shown in FIG. 7, the sample is loaded on a susceptor in a reactive etching apparatus (RIE). The reactive etching is a method of etching an object by setting the object on one of a pairing of parallel planar electrodes, making the chamber vacuous, replenishing a reactive gas in the vacuum chamber, applying an RF (radio frequency) voltage between the pairing electrodes, converting the gas into plasma, and letting the reactive ions of the plasma collide with the sample. 60 sccm of hydrogen gas containing 10 vol % of oxygen gas ($O_2/(H_2+O_2)$)=0.1) is supplied into the RIE apparatus which is kept at a total pressure of 1 Torr (133 Pa).

400 W of RF power is applied between the ing of electrodes. The RF oscillation generates plasma including active oxygen ions, oxygen radicals and hydrogen radicals. The boron-doped diamond layer (2) is etched by the plasma, in particular, by oxygen radicals for 35 minutes. The parts protected by the resist pattern are left intact. Only the parts not covered with the resist (7) are etched away. The bottom non-doped diamond (1) is not etched away, because the etching comes to end at the interface between the boron-doped diamond (2) and the lower non-doped layer (1). The etching thickness is controlled by the etching time.

In process step +e,cir +b 6+ee , the photoresist is removed from the top of the remaining boron-doped diamond parts (2) by some solvent. The boron-doped parts (2) protected by the resist (7) are revealed, as shown in FIG. 7.

Figure 8:
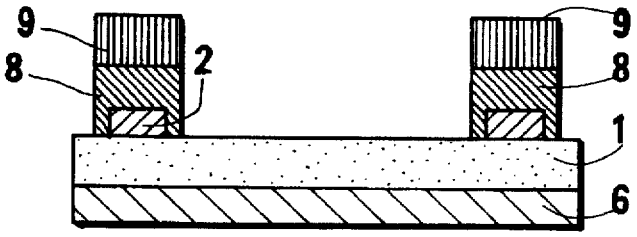
FIG. 8 is a Y—Y sectioned view in FIG. 1 of the Si substrate, the non-doped diamond, the selectively left boron-doped diamond and the electrodes at process step +e,cir +b 7+ee .

Referring to FIG. 8, in process step +e,cir +b 7+ee , the sample is loaded in a vacuum evaporation apparatus. Titanium pads (8) are evaporated to achieve a thickness of 0.1 μm on the ends of the conductive boron-doped line (2). Then platinum (Pt) (9) is further evaporated to a thickness of 0.1 μm on the titanium pads (8). Titanium (8) makes an ohmic contact (10) with the p-type diamond semiconductor. Pt coating (9) protects the titanium pads (8) from oxidization or corrosion.

Figure 9:
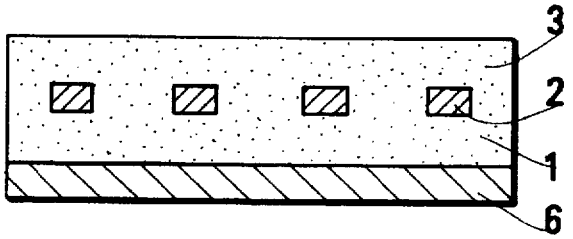
FIG. 9 is an X—X sectional of FIG. 1 view of the Si substrate, the lower non-doped diamond, the sparsely remaining boron-doped diamond layer and another non-doped diamond at process step +e,cir +b 8+ee , wherein another non-doped diamond layer is deposited.

Referring to FIG. 9, in process step +e,cir +b 8+ee , the sample is taken off from the evaporation apparatus. The sample is again set on the susceptor in the ECR plasma CVD apparatus. The chamber is made vacuous. Hydrogen gas including 3 vol % of methane ($CH_4$) is supplied into the CVD chamber at a rate of 100 sccm under a pressure of 15 Torr (2000 Pa). A microwave of 300 W is applied to the CVD chamber for 20 hours. The silicon substrate (6) is kept at 500° C. in the meantime.

Methane is exited into plasma by the microwave. Further, a part of the methane is excited to carbon radicals or carbon atoms. The excited carbon atoms fall on the sample and deposit a diamond layer thereon. The diamond is non-doped one (3). Thus the non-doped diamond layer (3) covers the boron-doped diamond pattern (2) which has been produced through process step +e,cir +b 3+ee to +e,cir +b 6+ee and the non-doped diamond bottom layer (1) made in process step +e,cir +b 2+ee . The non-doped diamond layer (3) is grown up to a height of 100 μm from the top of the boron-doped layer (2). The intermediate boron-doped conductive diamond (2) is sandwiched between the bottom insulating diamond (1) of a 100 μm thickness and the top insulating diamond (3) of a 100 μm thickness. FIG. 9 shows the sample at the end of process step +e,cir +b 8+ee .

Figure 10:
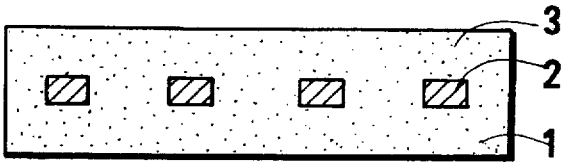
FIG. 10 is an X—X sectional view of the bottom non-doped diamond, the continually remaining boron-doped diamond layer and another non-doped diamond at process step +e,cir +b 9+ee , wherein the silicon substrate has been eliminated.

In process step +e,cir +b 9+ee , the silicon substrate (6) is removed by fluoric acid. The sample is shown by FIG. 10. The entire sample is constructed only with diamond. The sample now includes no non-diamond material except for the electrode metal.

Figure 11:
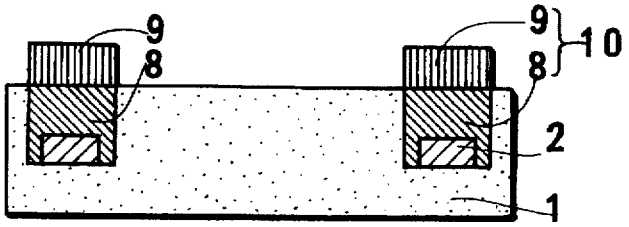
FIG. 11 is a sectional view of the lower non-doped diamond, the partially remaining boron-doped diamond layer, another non-doped diamond and electrodes at process step +e,cir +b 10+ee , wherein ohmic electrodes are revealed on the ends of the boron doped diamond path.

In process step +e,cir +b 10+ee , the parts of diamond covering the electrodes (4) and (10) are etched away by the photolithograpy and the reactive etching mentioned in process step +e,cir +b 5+ee and process step +e,cir +b 6+ee . The electrodes (4) are revealed. FIG. 11 shows the result.

These processes bring about the diamond heater of this invention. The diamond heater is suitable for the use at low temperature, or at high temperature in an anaerobic atmosphere. In the case of the use at high temperature in an oxidizing atmosphere, the sample should be further treated with an additional process for avoiding oxidization.

Figure 12:
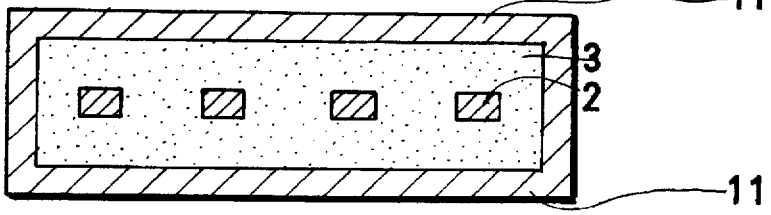
FIG. 12 is a sectional view of another diamond heater coated with a carbide film.

Referring to process step +e,cir +b 11+ee , as shown in FIG. 12, titanium (Ti) or silicon (Si) is evaporated on the whole surfaces of the sample of process step +e,cir +b 9+ee . Then the sample is annealed. The surface of the sample is converted to titanium carbide (TiC) (11) or silicon carbide (SiC) (11). Diamond is fully covered with the carbide (11) which enjoys a quite high resistance to oxidization or corrosion. The diamond is entirely protected by the superficial carbide (11) from oxygen or other contaminants. The diamond is not oxidized even at a high temperature in an aerobic atmosphere.

Figure 14:
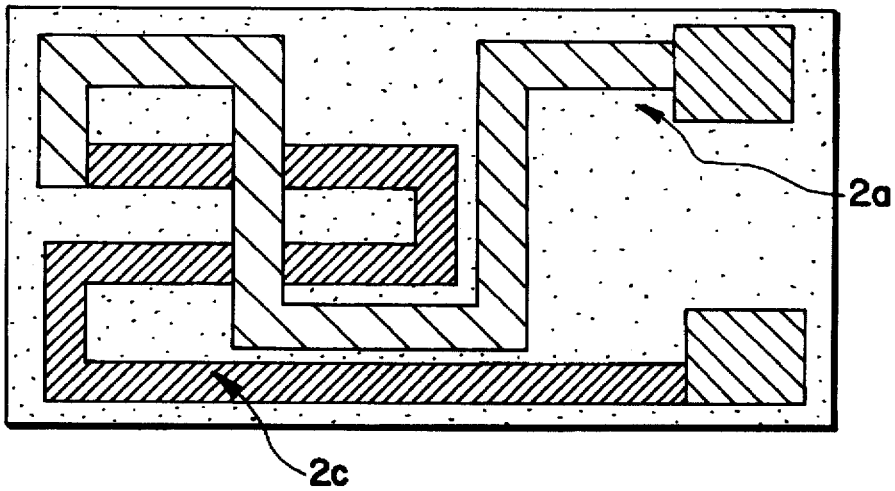
FIG. 14 is a plan view of a layered heater having a plurality of boron-doped conductive lines connected to electrodes.
Figure 15:
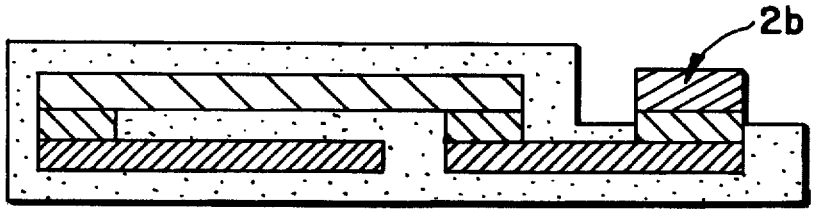
FIG. 15 is a side sectional view of the layered heater of FIG. 14.

The embodiment which has been described is a planar, two-dimensional heater with a single boron-doped layer. This invention has some variations to this embodiment. For example, this invention can make a multilayered heater which has more than two boron-doped diamond layers. The repetitions of process steps $\hat{2}$, $\hat{3}$, $\hat{4}$, $\hat{5}$, $\hat{6}$ and +e,cir +b 8+ee produce a plurality of planar boron-doped layers sandwiched between two non-doped diamond layers. The multilayered heater is a three-dimensional heater in which the plurality of heater lines are connected in series or in parallel. For example, in FIGS. 14 and 15, first, second and third conductive lines 2*a*, 2*b*, and 2*c* are connected. The three-dimensional heater is favored with a high density of heat radiation.

Another version is a heater which has a plurality of boron-doped conductive lines between the same two electrodes as parallel resistances. The version can generate heat with greater density and can heat an object hotter than the embodiment of the single boron-doped line.

Furthermore, another version has a set of conductive lines which connects two electrodes as parallel resistors. This version has the advantage of reducing the effective resistance of the conductive lines. It is far more difficult to dope impurity atoms into diamond than silicon, as mentioned before. Even boron atoms are frequently impeded from penetrating into the diamond crystal. Thus the boron-doped lines often have poor conductivity. In this case, the parallel lines reduce the resistance effectively.

Another example of the heater has three or more than three electrodes and a pertinent number of conductive lines connecting the electrodes.

The embodiment has adopted silicon as the substrate material. Another material, for example, molybdenum (Mo) or nickel (Ni), can be employed as the substrate. After the diamond growth, the substrate will be eliminated by etching with an appropriate etchant or by grinding with a whetstone.

What we claim is:

1. A diamond heater comprising:

at least one continual conductive line with ends, the at least one conductive line and the ends being made of boron-doped single crystal diamond or boron-doped polycrystal diamond;

insulating parts enclosing the at least one conductive line and being made of non-doped single crystal diamond or non-doped polycrystal diamond; and ohmic electrodes formed on the ends of the at least one conductive line, wherein a current flows in the at least one conductive line, thereby generating Joule's heat, when a voltage is applied between the electrodes.

2. A diamond heater as claimed in claim 1, wherein the ohmic electrodes comprise a Ti layer deposited on the ends of the at least one conductive line, and an Au or a Pt layer formed on the Ti layer.

3. A diamond heater as claimed in claim 1, wherein the at least one conductive line has a boron concentration higher than $10^{19}$ $cm^{-3}$.

4. A diamond heater as claimed in claim 1, wherein the ends of the at least one conductive line are wider than other parts of the at least one conductive line, thereby permitting a reduction in contact resistance between the electrodes and the at least one conductive line.

5. A diamond heater as claimed in claim 1, wherein the ends of the at least one conductive line have a higher concentration of boron atoms than other parts of the at least one conductive line, thereby permitting a reduction in contact resistance between the electrodes and the at least one conductive line.

6. A diamond heater as claimed in claim 1, wherein the at least one conductive line meanders a plurality of times like a comb in a single, planar layer.

7. A diamond heater as claimed in claim 1, wherein the at least one conductive line has a spiral shape with an inner end and an outer end formed in a single, planar layer.

8. A diamond heater comprising:

at least one continual conductive line with ends, the at least one continual conductive line and the ends being made of boron-doped single crystal diamond or boron-doped polycrystal diamond;

insulating parts enclosing the at least one conductive line and being made of non-doped single crystal diamond or non-doped polycrystal diamond;

ohmic electrodes formed on the ends of the at least one conductive line; and a carbide layer enclosing the non-doped diamond insulating parts, wherein a current flows in the at least one conductive line, thereby generating Joule's heat, when a voltage is applied between the electrodes.

9. A diamond heater as claimed in claim 8, wherein the carbide layer includes silicon carbide.

10. A diamond heater as claimed in claim 8, wherein the carbide layer includes titanium carbide.

11. A diamond heater comprising:

a plurality of continual conductive lines having respective ends, the continual conductive lines and respective ends each being made of boron-doped single crystal diamond or boron-doped polycrystal diamond;

insulating parts enclosing the plurality of conductive lines and being made of non-doped single crystal diamond or non-doped polycrystal diamond; and ohmic electrodes formed on the ends of the plurality of conductive lines, wherein a current flows in the plurality of conductive lines, thereby generating Joule's heat, when a voltage is applied between the electrodes.

12. A diamond heater as claimed in claim 11, wherein the plurality of conductive lines are formed on a plurality of layers, and further wherein the plurality of conductive lines each are connected in series to each other.

13. A diamond heater as claimed in claim 11, wherein the plurality of conductive lines are formed on a plurality of layers, and further wherein the plurality of conductive lines each are connected in parallel to the electrodes.

* * * * *